US008757610B2

(12) United States Patent
Nakayama

(10) Patent No.: US 8,757,610 B2
(45) Date of Patent: Jun. 24, 2014

(54) IMAGE READER AND SHEET FEEDING DEVICE

(71) Applicant: Daisuke Nakayama, Nagoya (JP)

(72) Inventor: Daisuke Nakayama, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/690,383

(22) Filed: Nov. 30, 2012

(65) Prior Publication Data

US 2013/0134667 A1 May 30, 2013

(30) Foreign Application Priority Data

Nov. 30, 2011 (JP) ..... 2011-262884

(51) Int. Cl.
*B65H 3/06* (2006.01)

(52) U.S. Cl.
USPC ..... 271/109; 384/418

(58) Field of Classification Search
USPC ..... 384/215, 441, 439, 418, 419, 125; 492/18, 49, 17, 47, 15; 271/109, 145, 271/207, 264, 121
See application file for complete search history.

(56) References Cited

U.S. PATENT DOCUMENTS 4,624,585 A * 11/1986 Nix et al. ..... 384/296
4,750,878 A * 6/1988 Nix et al. ..... 384/296
5,573,338 A 11/1996 Morikawa et al.
6,267,373 B1 * 7/2001 Takata ..... 271/274
6,467,965 B1 * 10/2002 Wyer ..... 384/295
7,080,836 B2 * 7/2006 Hamada et al. ..... 271/274
2007/0000966 A1 * 1/2007 Tsusaka et al. ..... 226/101
2009/0166962 A1 * 7/2009 Osakabe et al. ..... 271/264
2009/0218763 A1 9/2009 Terada

FOREIGN PATENT DOCUMENTS

JP 61-113752 U 7/1986
JP 5-83770 U 11/1993
JP 6156796 A 6/1994
JP 6156798 A 6/1994
JP 7309462 A 11/1995
JP 2000264483 A 9/2000
JP 2009203065 A 9/2009

* cited by examiner

*Primary Examiner* — Thomas Morrison
(74) *Attorney, Agent, or Firm* — Banner & Witcoff, Ltd.

(57) ABSTRACT

An image reader may include a shaft, a roller, a guide, and a first side plate comprising a frame portion having a first frame portion, a pair of second frame portions, and a third frame portion connecting with the pair of second frame portions and a first hole surrounded by the frame portion. A first bearing member may be fitted in the first hole and include a bearing portion contacting the first frame portion. The first bearing member may be configured such that an end of the shaft is rotatably held. An engaged portion may extend from the bearing portion and include an engagement portion engaged with the first side plate. The image reader may further include a second side plate, a second bearing member disposed at the second side plate and configured such that the opposite side of the shaft is rotatably held, and a reading unit.

9 Claims, 13 Drawing Sheets

84

84

IMAGE READER AND SHEET FEEDING DEVICE

CROSS-REFERENCE TO RELATED APPLICATION

This application claims priority from Japanese Patent Application No. 2011-262884 filed on Nov. 30, 2011, the content of which is incorporated herein by reference in its entirety.

TECHNICAL FIELD

Aspects described herein relate to an image reader and a sheet feeding device configured to feed a sheet.

BACKGROUND

A known image scanner or printer includes a sheet feeding device configured to feed sheets. For example, an image scanner includes a sheet feeding path extending through an image reading unit. The sheet feeding device feeds sheets along the sheet feeding path.

The sheet feeding device includes a guide member extending along the sheet feeding path and a roller member including a shaft and a roller mounted thereon. A side plate is provided on each side of the guide member. The guide member is supported by the side plates. Each side plate has a circular hole in which a bearing is fitted. The roller member is disposed between the side plates while each end of the shaft is rotatably inserted into the bearing.

As the roller member rotates, a feeding force is applied from the roller to a sheet making contact with a peripheral surface of the roller, so that a sheet is fed along the sheet feeding path. At this time, the guide member guides the sheet being fed.

To make the peripheral surface of the roller contact the sheet, a portion of the peripheral surface of the roller needs to protrude from the guide member toward the sheet feeding path. For example, an opening corresponding to the size of the roller is formed on the guide member. A portion of the peripheral surface of the roller may protrude from the guide member toward the sheet feeding path by disposing the roller in the opening from a side opposite to the sheet feeding path.

BRIEF SUMMARY

If the roller is disposed in the opening of the guide member, an amount of movement of the roller member in its axial direction may be limited to a distance between the roller and a peripheral edge of the opening in the axial direction of the roller member. Therefore, the shaft of the roller member may not be able to be pulled from the side plate, without having to remove the side plate from the guide member. Accordingly, at least one of the side plates may have to be removed from the guide member to remove the roller member from the side plates having the circular holes. Such a configuration and process may be troublesome and require more time to remove the roller member from the side plates.

According to one aspect of the disclosure, an image reader may include a shaft, a roller, a guide, a first side plate, a first bearing member, a second side plate, a second bearing member, and a reading unit. The roller may be mounted on the shaft. The roller may be configured to rotate on the shaft and feed a sheet. The guide may have an opening at which the roller is disposed. The first side plate may be disposed on one side of the guide member in an axial direction of the shaft. The first side plate may comprise a frame portion and a first hole. The frame portion may comprise a first frame portion, a pair of second frame portions and a third frame portion. The pair of second frame portions may extend in an extending direction perpendicular to the axial direction from the first frame portion. The third frame portion may connect with the pair of second frame portions. The first hole may be surrounded by the frame portion. The one side of the shaft may be inserted into the first hole. The first bearing member may be fitted in the first hole. The first bearing member may comprise a bearing portion and an engaged portion. The bearing portion may contact the first frame portion. The bearing portion may be configured such that an end of the shaft is rotatably held. The engaged portion may extend in the extending direction from the bearing portion. The engaged portion may comprise an engagement portion engaged with the first side plate. The second side plate may be disposed on an opposite side of the guide member in the axial direction of the shaft. The second side plate may have a second hole. The opposite side of the shaft may be inserted in the second hole. The second bearing member may be disposed at the second side plate. The second bearing member may be configured such that the opposite side of the shaft is rotatably held. The reading unit may be configured to read an image of the sheet.

According to one or more other aspects, a sheet feeding device may comprise a roller member, a guide member, a side plate, and a bearing member. The roller member may comprise a shaft and a roller mounted on the shaft. The roller member may be configured to feed a sheet that contacts a peripheral surface of the roller. The guide member may comprise an accommodating portion configured to accommodate the roller therein. A portion of the peripheral surface of the roller may protrude from the guide member. The side plate may be disposed on one side of the guide member in an axial direction of the shaft. The side plate may comprise a bearing holding portion including a bearing holding hole extending in an extending direction perpendicular to the axial direction. The bearing member may be configured such that an end of the shaft is rotatably held on the one side. The bearing member may be fitted in the bearing holding hole.

BRIEF DESCRIPTION OF THE DRAWINGS

For a more complete understanding of the disclosure, needs satisfied thereby, and the objects, features, and advantages thereof, reference is now made to the following description taken in connection with the accompanying drawings.

DETAILED DESCRIPTION

Figure 1:
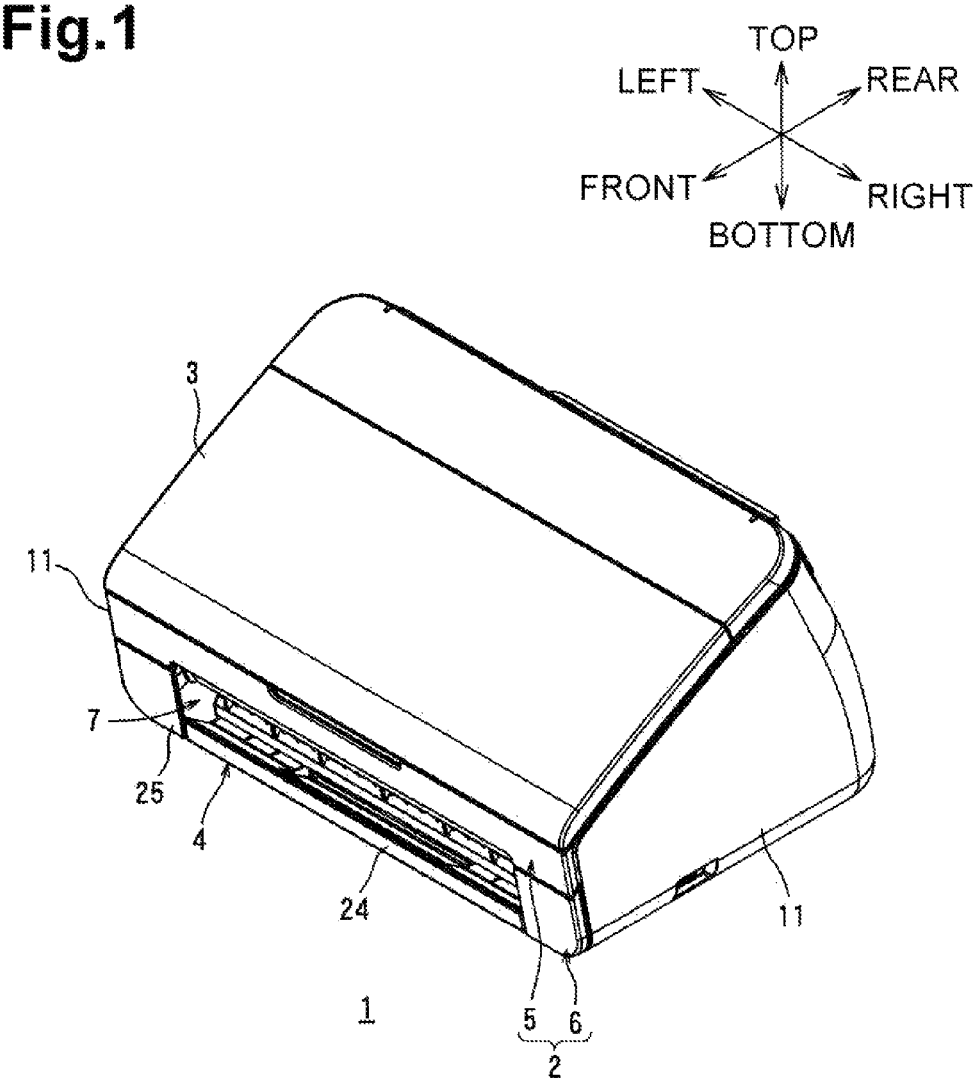
FIG. 1 is a perspective view of an image scanner in an example embodiment according to one or more aspects of the disclosure, wherein the image scanner is unused.

Example embodiments are described in detail herein with reference to the accompanying drawings, like reference numerals being used for like corresponding parts in the various drawings.

As depicted in FIG. 1, an image scanner 1 may comprise a scanner body 2, a sheet supply tray 3, and an output tray 4.

The scanner body 2 may comprise an upper unit 5 and a lower unit 6. A sheet output opening 7 may be formed on a front side of the scanner body 2 to straddle the upper unit 5 and the lower unit 6.

Front, rear, left, right, top, and bottom sides of the image scanner 1 may be defined in conjunction with an orientation in which the image scanner 1 placed on a plane surface is viewed from its front side. To facilitate understanding of orientation of the image scanner 1, its front, rear, left, right, top, and bottom sides may be determined with reference to axes of the three-dimensional Cartesian coordinate system included in each of the relevant figures.

Figure 2:
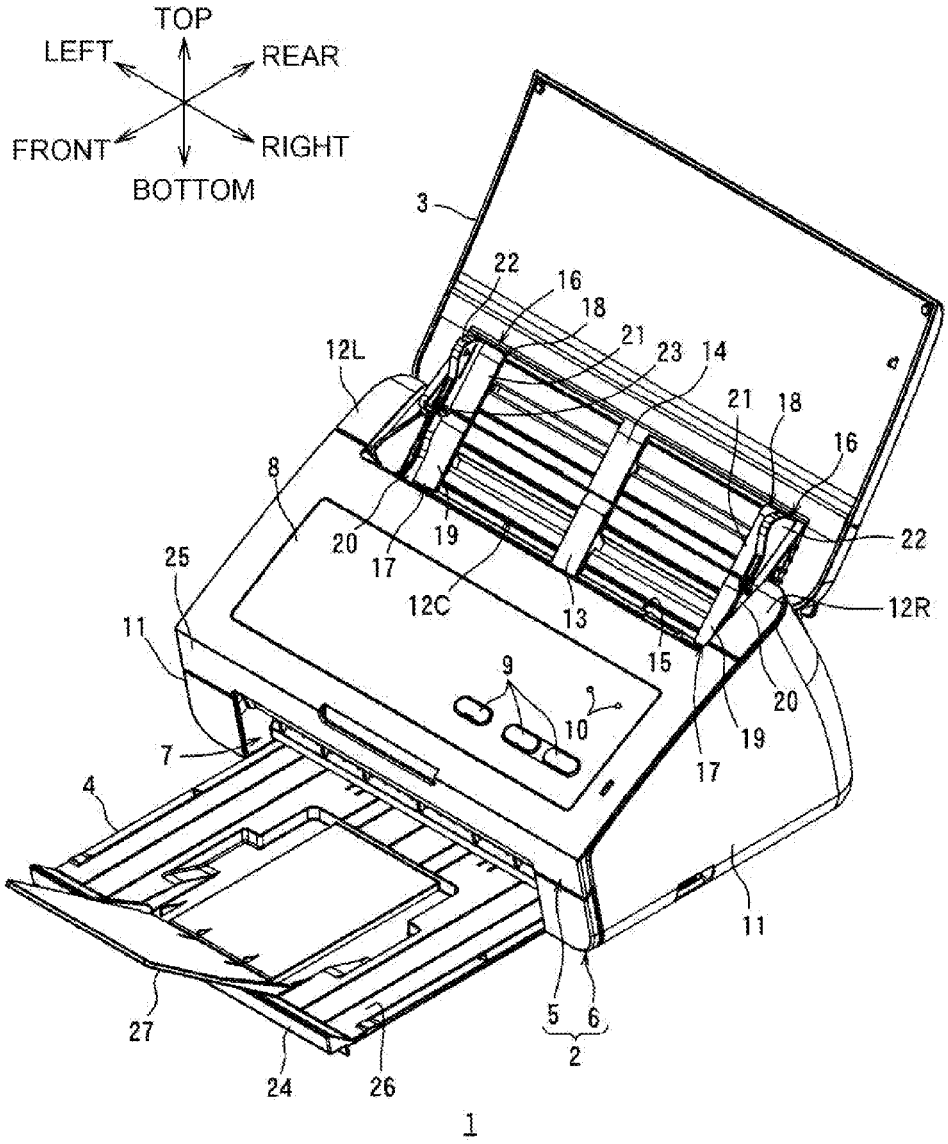
FIG. 2 is a perspective view of the image scanner, wherein the image scanner is used.

The upper unit 5 may be pivotally coupled to the lower unit 6 about an axis extending laterally, e.g., in a left-right direction of the scanner 1, along the front upper end of the lower unit 6. The upper unit 5 may pivotally move to a normal position, e.g., the position as depicted in FIG. 2, and a maintenance position (not depicted). In a normal position, the upper unit 5 may slant forwardly and downwardly. In a maintenance position, the rear end of the upper unit 5 placed in the normal position may be raised upwardly. In the maintenance position, a portion between the upper unit 5 and the lower unit 6 may be exposed, so that sheet jams may be cleared or maintenance of the scanner 1 may be performed.

As depicted in FIG. 2, a control panel 8 may be provided on an upper surface of the upper unit 5. The control panel 8 may comprise a plurality of buttons 9 and pilot lamps 10.

The lower unit 6 may comprise a side panel 11 on each right and left end thereof. The side panel 11 may have a trapezoidal shape when viewed from the side of the image scanner 1. The side panels 11 may define the right and left sides of the image scanner 1. When the upper unit 5 is in the normal position, the side panels 11 may sandwich the upper unit 5 in the lateral direction so as to cover right and left side surfaces of the upper unit 5. In the normal position, an upper surface of the upper unit 5 may be disposed approximately within the same plane as an upper edge of each side panel 11.

The lower unit 6 may comprise a central portion 12C positioned at a central portion of an upper rear end portion of the lower unit 6 in the lateral direction, a left end portion 12L positioned on the left side of the central portion 12C and a right end portion 12R positioned on the right side of the central portion 12C. An upper surface of the central portion 12C may slant forwardly and downwardly. The central portion 12C may assist in feeding the sheets from the sheet supply tray 3. The central portion 12C may support a body-side guide member 13 of approximately a rectangular shape, at a central portion of the central portion 12C in the lateral direction. The body-side guide member 13 may assist in guiding the sheets in the sheet feeding direction.

The left and right end portions 12L, 12R may protrude upward from the central portion 12C. The left and right end portions 12L, 12R may have substantially a rectangular parallelepiped shape. When the upper unit 5 is in the normal position, upper surfaces of the left and right end portions 12L, 12R may be approximately flush with the upper surface of the upper unit 5. A right side surface of the left end portion 12L and a left side surface of the right end portion 12R may each comprise a supporting shaft (not depicted) extending collinearly and inwardly in the lateral direction.

The supporting shafts may pivotally support the sheet supply tray 3. The sheet supply tray 3 may pivotally move to a folded position as depicted in FIG. 1 and an extended position as depicted in FIG. 2. In the folded position, the sheet supply tray 3 may lay against an upper (or top) surface of the scanner body 2. In the extended position of some example arrangements, the sheet supply tray 3 may extend rearward and upwardly from an upper rear end of the scanner body 2 at approximately the same angle as an inclination angle of the central portion 12C. The sheet supply tray 3 may have a plate shape, which may be substantially the same shape and surface area as the upper (or top) surface of the scanner body 2. Therefore, the sheet supply tray 3 may cover the upper surface of the scanner body 2 when the sheet supply tray 3 is in the folded position.

An inner surface of the sheet supply tray 3, e.g., the surface facing upward (in the top direction) when the sheet supply tray 3 is in the extended position, may comprise a tray-side guide member 14 of a substantially rectangular shape in one or more example arrangements. The tray-side guide member 14 may be supported by the inner surface of the sheet supply tray 3 so as to be disposed at a front end of the sheet supply tray 3 and behind the body-side guide member 13 when the sheet supply tray 3 is in the extended position.

A sheet feed opening 15 may be disposed in front of the central portion 12C when the sheet supply tray 3 is in the extended position. The sheet feed opening 15 may extend in the lateral direction and may have an approximately rectangular shape.

A pair of sheet width guide members 16 may be disposed over the central portion 12C when the sheet supply tray 3 is in the extended position.

Each sheet width guide member 16 may comprise a body-side guide member 17 and a tray-side guide member 18.

The body-side guide member 17 may comprise a sheet placing portion 19 and a width regulating portion 20 that may be formed integrally in some examples. The sheet placing portion 19 may be disposed along the upper surface of the central portion 12C. Additionally or alternatively, the sheet placing portion 19 may have substantially a rectangular shape. The sheet placing portion 19 may have substantially the same shape as the body-side guide member 13. The width regulating portion 20 may stand perpendicularly to the sheet placing portion 19 from an outer edge of the sheet placing portion 19 in the lateral direction and extends in the front-rear direction.

Perpendicular may correspond to an angle of 90 degrees, as well as angles that are approximately 90 degrees including some tolerances, to a given line, plane, or surface.

The tray-side guide member 18 may comprise a sheet placing portion 21 and a width regulating portion 22 that may be formed integrally in some arrangements. The sheet placing portion 21 may be disposed along the upper surface of the central portion 12C. In some examples, the sheet placing portion 21 may have substantially a rectangular shape. Additionally or alternatively, the sheet placing portion 21 may have substantially the same shape as the tray-side guide member 14. The width regulating portion 22 may stand perpendicular to the sheet placing portion 21 at an outer edge of the sheet placing portion 21 in the lateral direction and extends in the front-rear direction.

The width regulating portion 20 of the body-side guide member 17 may comprise a coupling shaft 23 extending laterally from a rear end of the width regulating portion 20. An axis of the coupling shaft 23 may correspond to an axis of the supporting shaft, which may allow the sheet supply tray 3 to pivot. The width regulating portion 22 of the tray-side guide member 18 may comprise an overlapping portion that may overlap laterally with the rear end of the width regulating portion 20. A tip of the coupling shaft 23 may be inserted into a hole formed in the overlapping portion. With such a structure, in accordance with the pivotal movement of the sheet supply tray 3, the tray-side guide members 18 may pivot on the coupling shafts 23. When the sheet supply tray 3 is in the extended position, the body-side guide member 17 and the tray-side guide member 18 may align in a front-rear direction of the scanner 1.

According to some configurations, each of the sheet width guide members 16 may move by the same amount with the center therebetween as a reference, so as to approach or separate from each other.

At a minimum distance between the sheet width guide members 16, e.g., when the sheet width guide members 16 move closest to each other, the distance between the left and right width regulating portions 20, 22 may, in one example, generally correspond to a length of the shorter side of a business card. A business card may be placed over the guide members 13, 14, and the sheet placing portions 19, 21 of the sheet width guide members 16. In other embodiments, the minimum distance may be less than the length of the shorter side of a sheet of a business card.

At a maximum distance between the sheet width guide members 16, e.g., when the sheet width guide members 16 move furthest from each other, the distance between the left and right width regulating portions 20, 22 may, in one example, generally correspond to a length of the shorter side of a legal size sheet. A front end, e.g., a leading end, of a legal size sheet may be placed over the guide members 13, 14, and the sheet placing portions 19, 21 of the sheet width guide members 16. In other embodiments, the maximum distance may be even greater than the length of the shorter side of a legal size sheet.

As to sheet sizes bigger than a business card size and smaller than the legal size, a pair of sheet width guide members 16 may be moved to make the distance between the width regulating portions 20, 22 correspond to the size of the sheet in its lateral direction. Thus, the sheet may be placed over the guide members 13, 14, and the sheet placing portions 19, 21 of the sheet width guide members 16.

Thus, sheets may be set over the upper rear end of the lower unit 6 of the scanner body 2 and the sheet supply tray 3, such that the center of the sheets in their lateral direction corresponds to the center of the distance between the guide members 16, e.g., the center of the sheet feed opening 15 in its lateral direction.

In some example configurations, the output tray 4 may have an approximately rectangular plate shape. The output tray 4 may move to an accommodated position, as depicted in FIG. 1, in which the tray 4 is accommodated in a lowermost part of the lower unit 6, and a pulled position, as depicted in FIG. 2, in which the tray 4 is pulled in front of the scanner body 2 from the sheet output opening 7. In the accommodated position, a front face 24 of the output tray 4 may be flush with a front face 25 of the scanner body 2. In the pulled position, an upper surface 26 of the tray 4 may face upward as a sheet receiving surface, as depicted in FIG. 2.

An extension plate 27 may be pivotally provided on the upper surface 26 about an axis extending along a front end of the output tray 4. The extension plate 27 may move to a folded position in which the extension plate 27 is folded down toward the upper surface 26 and to an extended position, as shown in FIG. 2, in which the extension plate 27 is extended in an upward and forward direction from the front end of the upper surface 26 when the output tray 4 is pulled forwardly from the scanner body 2.

Figure 3:
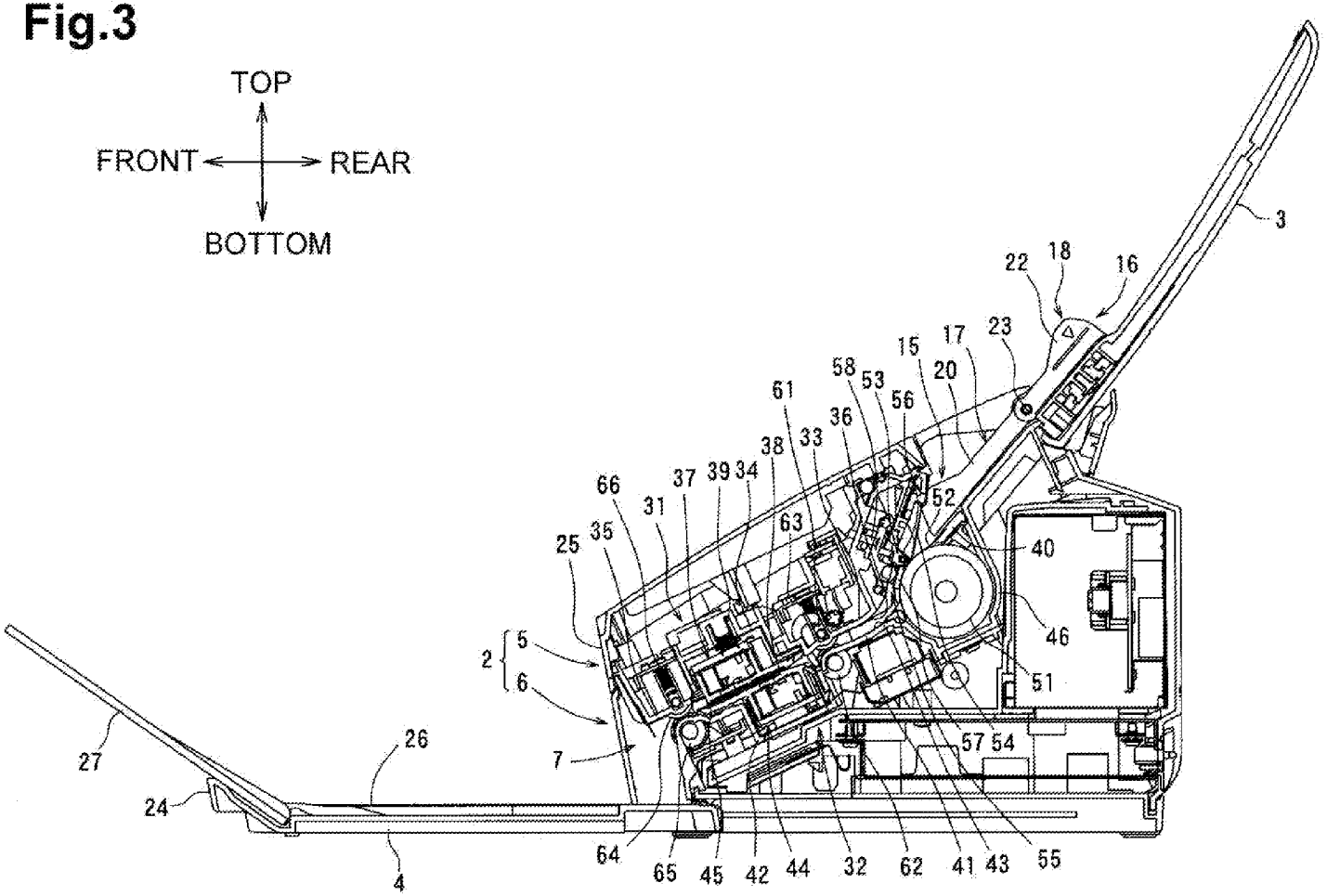
FIG. 3 is a side sectional view of the image scanner.

As depicted in FIG. 3, the upper unit 5 and the lower unit 6 may comprise an upper frame 31 and a guide member, e.g., a lower frame 32, respectively. Rear edges of the upper frame 31 and the lower frame 32 may define the sheet feed opening 15.

The upper frame 31 may comprise a first upper guide 33, an upper contact image sensor (CIS) holder 34 and a final guiding portion 35 formed in this order from the rear side of the scanner 1.

A lower surface of the first upper guide 33 opposing the lower frame 32 may function as a guide surface 36 to guide a sheet. The guide surface 36 may comprise a sharp sloping rear end portion, a middle curve portion, and a gentle sloping front end portion. The sharp sloping portion at the rear end portion of the guide surface 36 may extend in a forward and downward direction at a relatively sharp inclination. The curve portion at the middle portion of the guide surface 36 may include a concave curve from a rear and top location to a front and lower location. The gentle sloping portion at the front end portion of the guide surface 36 may extend in a forward and downward direction at a relatively gentle inclination.

The upper CIS holder 34 may have an approximately rectangular recess receding in a frontward and upward direction. The upper CIS holder 34 may hold an upper CIS unit 37 therein. The upper CIS unit 37 may comprise a contact glass 38. The upper CIS unit 37 may hold the contact glass 38 such that the glass 38 may be opposed to the lower frame 32. A coil spring 39 may be disposed between a base end surface of the upper CIS holder 34 and the upper CIS unit 37. When a sheet being fed is thick, the upper CIS unit 37 may move according to the thickness of the sheet, so that the sheet may be fed while favorably making contact with the contact glass 38.

The final guiding portion 35 may extend in a frontward and downward direction approximately at the same inclination angle as the front end portion of the guide surface 36.

The lower frame 32 may comprise a guide 40, a first lower guide 41, and a lower CIS holder 42 formed in this order from the rear side of the scanner 1.

An upper surface of the guide 40 may be formed into a nearly flat surface that may be inclined in a frontward and downward direction at approximately the same inclination angle of each upper surface of the guide members 13, 14, and the sheet placing portions 19, 21 of the sheet width guide members 16 where the sheets may be placed.

An upper surface of the first lower guide 41 opposing the upper frame 31 may function as a guide surface 43 to guide a sheet. The guide surface 36 of the first upper guide 33 and the guide surface 43 may have a space therebetween. In correspondence with the curvature of the guide surface 36, the guide surface 43 may protrude in a rearward and downward direction and extend in a forward and downward direction parallel to the front end of the guide surface 36.

Parallel lines, planes, etc. may extend in the same direction and may be equidistant at all or some points. In some examples, a parallel line, plane, etc. may slightly slant or curve with respect to another or others.

The lower CIS holder 42 may have an approximately rectangular recess receding in a rearward and downward direction. The lower CIS holder 42 may hold a lower CIS unit 44 therein. The lower CIS holder 42 may comprise a contact glass 45. The lower CIS holder 42 may hold the contact glass 45 such that the glass 45 may be opposed to the upper frame 31.

The lower frame 32 may comprise a roller accommodating portion 46. The roller accommodating portion 46 may have a recess receding in a rearward and downward direction at each central portion, in the lateral direction, of the guide 40 and the first lower guide 41.

The roller accommodating portion 46 may rotatably accommodate a pickup roller 51. A portion of a peripheral surface of the pickup roller 51 may protrude from upper surfaces of the guide 40 and the first lower guide 41 in a frontward and upward direction. The pickup roller 51 may rotate counterclockwise when viewed from the right side of the scanner 1, to feed a sheet.

A guide 52 may be disposed on an upper surface of the guide 40 so as to extend from the upper surface of the guide 40 to a portion of a peripheral surface of the pickup roller 51 protruding from the upper surface of the guide 40. The guide 52 may be disposed such that a center of the guide 52 in its lateral direction may correspond to a center of the pickup roller 51 in its lateral direction. The guide 52 may comprise a film in some examples. A base end of the guide 52 may be supported on the upper surface of the guide 40 and a free end of the guide 52 may contact a portion of the peripheral surface of the pickup roller 51.

The upper frame 31 may comprise a regulating member 53, a sheet pressing member 54, and a separation unit 55 in front of and at an upper side of the pickup roller 51.

The regulating member 53 may be disposed downstream of the guide 52 in a sheet feeding direction, such as a direction in which the sheet moves through the image scanner 1. The regulating member 53, from a side view, appears to point toward the pickup roller 51. The regulating member 53 may comprise a regulating surface 56. In the sectional view depicted in FIG. 3, the regulating surface 56 may extend substantially collinearly with a radius of the pickup roller 51 and perpendicular to a line extending along the upper surface of the guide 40.

The sheet pressing member 54 may comprise a plate spring. A base end of the sheet pressing member 54 may be attached to a rear end of the upper frame 31. A free end of the sheet pressing member 54 may contact a portion of the peripheral surface of the pickup roller 51 from above in front of the roller 51.

The separation unit 55 may comprise a separation pad 57. The separation pad 57 may comprise rubber in some examples. The separation pad 57 may be disposed downstream of the regulating member 53 in the rotational direction of the pickup roller 51. A surface of the separation pad 57 may elastically contact a portion of the peripheral surface of the pickup roller 51 by an urging force of a spring 58. The separation pad 57 may separate sheets one by one by making the sheets contact with one surface of the separation pad 57 on one side.

Line feed (LF) rollers 61, 62 may be rotatably disposed at front ends of the first upper guide 33 and the first lower guide 41, respectively, on axes extending laterally. A portion of the peripheral surface of the LF roller 61 may protrude in a rearward and downward direction from a lower surface, e.g., the guide surface 36, of a front end of the first upper guide 33. A portion of the peripheral surface of a roller, e.g., the LF roller 62, may protrude in a frontward and upward direction from an upper surface, e.g., the guide surface 43, of a front end of the first lower guide 41. The peripheral surface of the LF roller 61 may elastically contact the peripheral surface of the LF roller 62 from above and in front of the LF roller 62 as a result of a downward force applied by a spring 63.

Output rollers 64, 65 may be rotatably disposed at the final guiding portion 35 of the upper frame 31 and a front end of the lower frame 32, respectively, on axes extending laterally. A portion of the peripheral surface of the output roller 64 may protrude in a rearward and downward direction from a lower surface of the final guiding portion 35. A portion of the peripheral surface of a roller, e.g., the output roller 65, may protrude in a frontward and upward direction from an upper surface of a front end of the lower frame 32.

The image scanner 1 may selectively read an image formed on upper and lower surfaces, e.g., front and back sides, of a sheet. The scanner 1 may read an image on each side of the sheet simultaneously.

A distance between the guide members 16 may be adjusted to the size, e.g., a width, of a sheet to be read. Thereafter, a sheet to be read may be inserted between the guide members 16 from above and the rear side of the scanner 1. The sheet may be placed over the guide members 13, 14, and the sheet placing portions 19, 21 of the sheet width guide members 16. At this time, a leading end of the sheet may slide over the guide members 13, 14, and the sheet placing portions 19, 21. The leading end of the sheet may move to the guide 40 of the lower frame 32 though the sheet feed opening 15. The leading end of the sheet may further slide over the guide 40 toward the pickup roller 51.

When a stack of sheets is set in the scanner 1, a leading end of the lowermost sheet may move from the guide 40 to the guide 52. The central portion of the leading end of the sheet may slide over the guide 52 and be guided on the peripheral surface of the pickup roller 51. As the leading end of the lowermost sheet contacts the separation unit 55, the sheet may stop due to frictional resistance with the separation unit 55. Leading ends of an upper side of the stack of the sheets may stop by contacting the regulating surface 56 of the regulating member 53. Thus, even when a plurality of sheets are set in the scanner 1, sheets may be scanned one at a time (e.g., individually).

The free end of the sheet pressing member 54 may be raised by the sheets inserted between the peripheral surface of the pickup roller 51 and the sheet pressing member 54. The sheet pressing member 54 may contact the upper surface of the uppermost sheet. The lowermost sheet may be pressed against the peripheral surface of the pickup roller 51 as a result of a downward force applied by the sheet pressing member 54.

As the pickup roller 51 rotates counterclockwise (when viewed from the right), the lowermost sheet may be moved along with the peripheral surface of the pickup roller 51 by the frictional force between the lowermost sheet and the peripheral surface of the pickup roller 51. Sheets above the lowermost sheet may move following the lowermost sheet due to the frictional force applied between the lowermost sheet and the sheet directly above the lowermost sheet. However, the separation pad 57 may prevent sheets other than the lowermost sheet from passing a nip portion between the separation pad 57 and the peripheral surface of the pickup roller 51. In one example, the separation pad 57 may regulate movement of the rest of the sheets when the leading ends of the sheets contact the surface of the separation pad 57. Accordingly, the separation pad 57 may block the leading ends of sheets other than the lowermost sheet from proceeding forward.

The sheet passing the nip portion between the separation pad 57 and the peripheral surface of the pickup roller 51 may be fed along a sheet feed path defined by the guide surface 36 of the first upper guide 33 and the guide surface 43 of the first lower guide 41. That is, the guide surfaces 36, 43 may guide the sheet through the sheet feed path.

When the leading end of the sheet contacts a nip portion between the LF rollers 61, 62, the leading end may be pulled into the nip portion due to the rotation of the LF rollers 61, 62. The peripheral surfaces of the LF rollers 61, 62 may contact an upper surface and a lower surface of the sheet, respectively and feeding force may be applied to the sheet by the peripheral surfaces of the LF rollers 61, 62. Thus, the sheet may be continuously fed in the sheet feeding direction.

As the sheet is fed in the sheet feeding direction, the upper and lower surfaces of the sheet may face the contact glass 38 of the upper CIS unit 37 and the contact glass 45 of the lower CIS unit 44, respectively. Light may be emitted to the upper and lower surfaces of the sheet through light emitting portions of the contact glasses 38, 45. The upper and lower surfaces of the sheet may reflect the light. The light reflected off the upper and lower surfaces of the sheet may be received by image sensors contained in the upper CIS unit 37 and the lower CIS unit 44, respectively. Thus, images on the upper and lower surfaces of the sheet may be read.

When the leading end of the sheet contacts a nip portion between the output rollers 64, 65, the leading end may be pulled into the nip portion by the rotation of the output rollers 64, 65. The peripheral surfaces of the output rollers 64, 65 may contact the upper and lower surfaces of the sheet, respectively, and a feeding force may be applied to the sheet by the peripheral surfaces of the output rollers 64, 65. Thus, the sheet may be continuously fed in the sheet feeding direction. When a trailing end of the sheet moves away from the output rollers 64, 65, the sheet may be output onto the upper surface 26 of the output tray 4.

Figure 4:
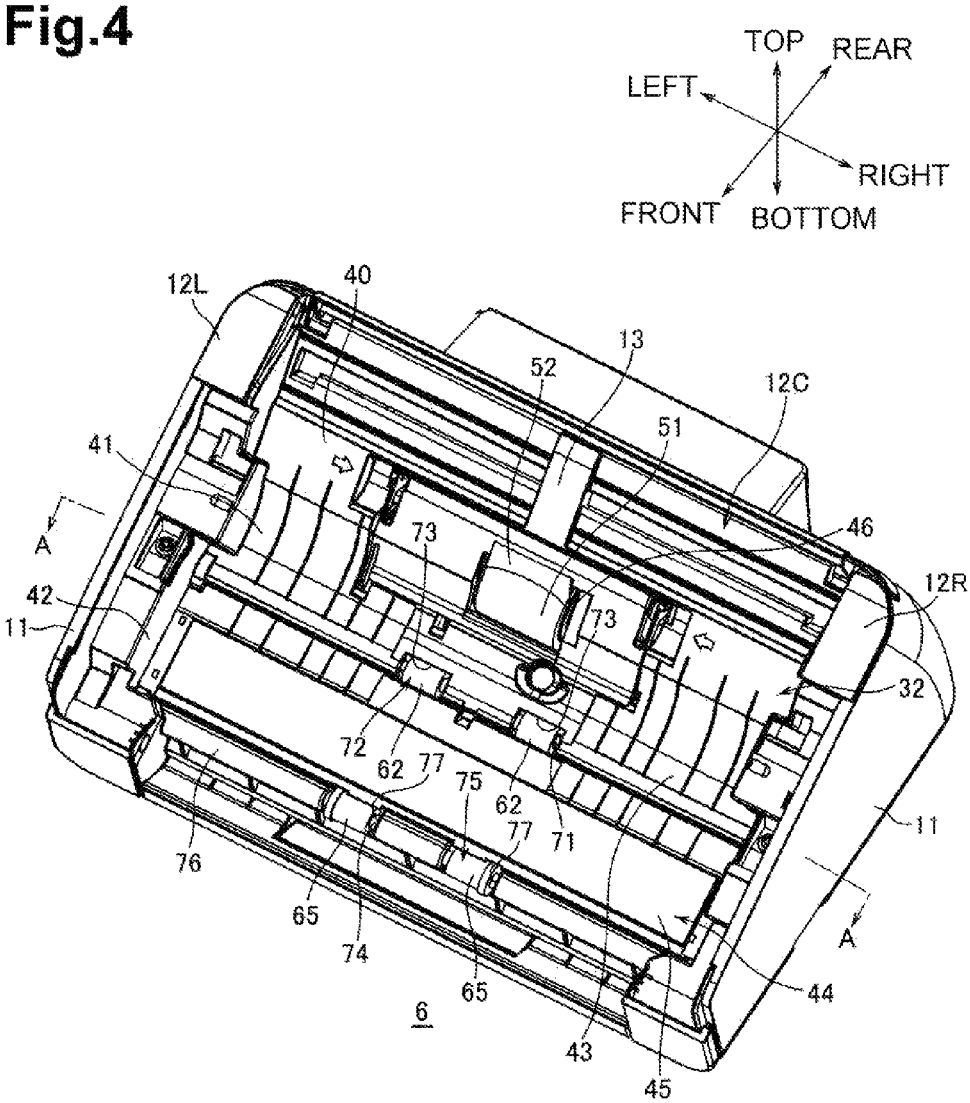
FIG. 4 is a perspective sectional view of a lower unit of the image scanner.

As depicted in FIG. 4, two LF rollers 62 may be disposed in the lower unit 6 with a distance therebetween in the lateral direction. The LF rollers 62 may be mounted on a middle portion of a shaft, e.g., a LF roller shaft 71, extending laterally. A roller member, e.g., a LF roller member 72, may comprise two LF rollers 62 and the LF roller shaft 71. The first lower guide 41 of the lower frame 32 may have an accommodating portion, e.g., a rectangular opening 73 in correspondence with each LF roller 62.

The LF roller shaft 71 may be disposed below the lower frame 32. Each LF roller 62 may be disposed in the relevant opening 73. A portion of the peripheral surface of each LF roller 62 may protrude upward from the guide surface 43, which may be an upper surface of the lower frame 32.

As depicted in FIG. 4, two output rollers 65 may be disposed in the lower unit 6 with a distance therebetween in the lateral direction. The output rollers 65 may be mounted on a middle portion of a shaft, e.g., an output roller shaft 74 extending laterally. A roller member, e.g., an output roller member 75, may comprise two output rollers 65 and the output roller shaft 74. A front end portion of the lower frame 32 may include a concave curve protruding forwardly and extending downward from the front end of the lower CIS holder 42. A surface of the concave curve of the front end portion of the lower frame 32 may function as a guide surface 76 guiding the sheet output by the output rollers 64, 65 (depicted in FIG. 3). The portion of the front end portion of the lower frame 32 protruding forwardly may have an accommodating portion, e.g., a rectangular opening 77, in correspondence with each output roller 65.

The output roller shaft 74 may be disposed below the lower frame 32. Each output roller 65 may be disposed in the relevant opening 77. A portion of the peripheral surface of each output roller 65 may protrude upward and frontward from the guide surface 76.

Figure 5:
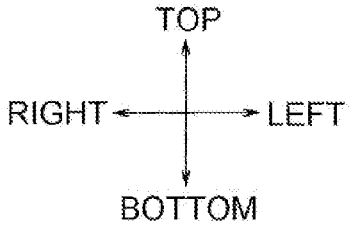
FIG. 5 is a sectional view of the lower unit taken along line A-A of FIG. 4.
Figure 5:
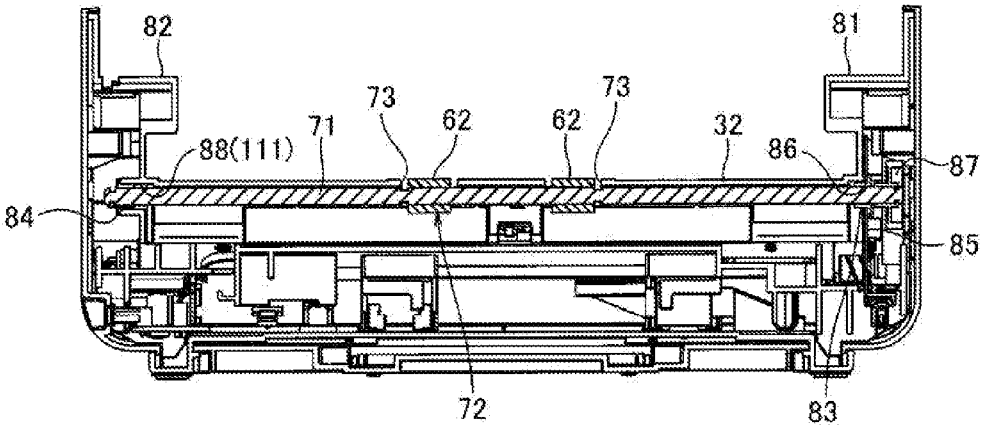

As depicted in FIG. 5, a pair of side plates including left and right side plates 81, 82 may be disposed opposite to each other on left and right sides of the lower frame 32, respectively. The lower frame 32 may be disposed between upper ends of the side plates 81, 82. The lower frame 32 and the side plates 81, 82 may be integrally formed of resin as one piece in some examples.

The LF roller member 72 may be disposed between the side plates 81, 82 and supported by the side plates 81, 82.

Left and right ends of the LF roller shaft 71 may be rotatably inserted into a left bearing 83 and a bearing member, e.g., a right bearing 84, respectively.

A plate, e.g., a metal plate 85 may be disposed on an outer surface of the left side plate 81. The left bearing 83 may be fitted in a left bearing holding hole 86 formed in the metal plate 85. The left bearing holding hole 86 may have a circular shape. The left end of the LF roller shaft 71 may protrude leftward from the left bearing 83. A LF roller gear 87 may be mounted on a portion of the LF roller shaft 71 protruding from the left bearing 83 so as not to rotate relative to the LF roller shaft 71, e.g., the LF roller gear 87 may rotate together with the LF roller shaft 71.

Figure 6:
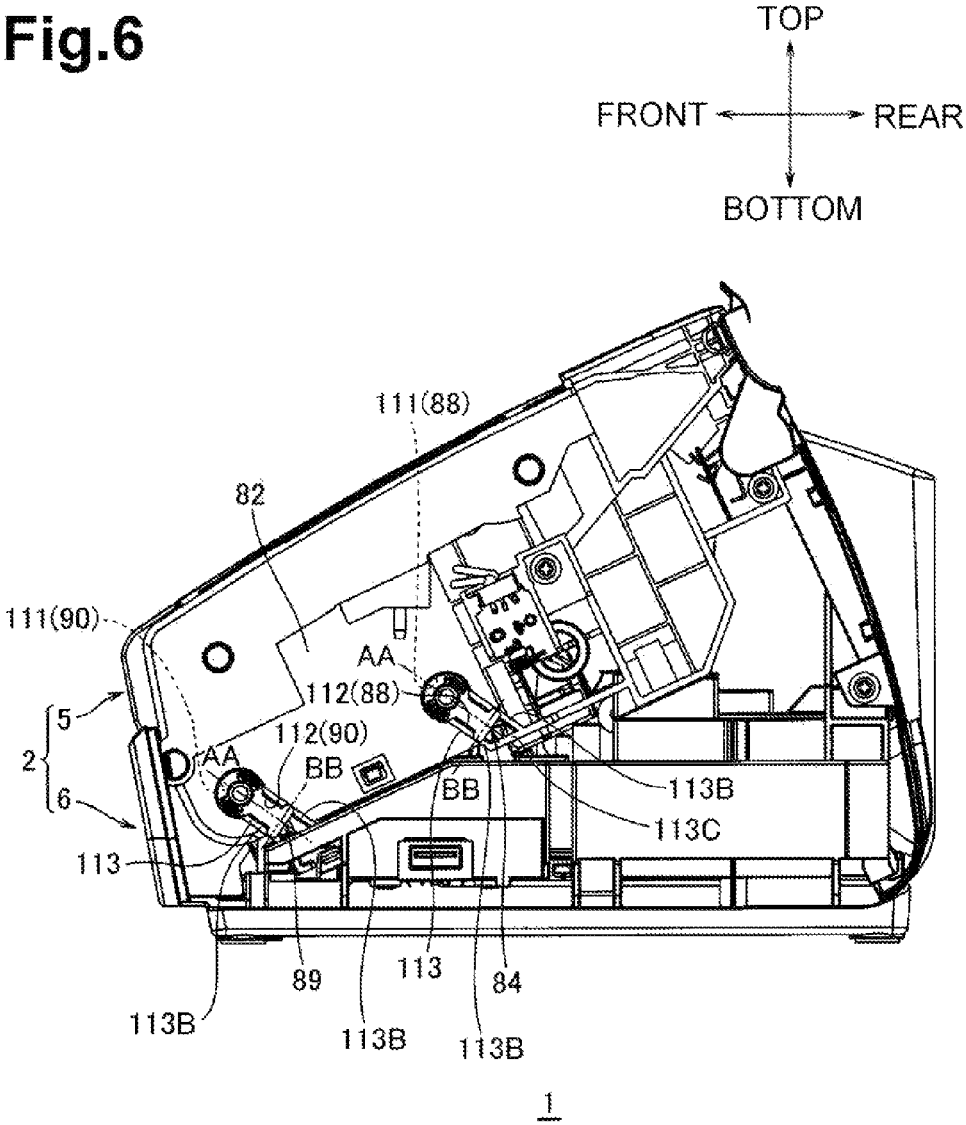
FIG. 6 is a right view of an upper unit and the lower unit of the image scanner.

As depicted in FIGS. 5 and 6, a right bearing 84 may be fitted in a bearing holding hole, e.g., a right bearing holding hole 88, formed in the right side plate 82.

The output roller member 75 may be disposed between the side plates 81, 82 and supported by the side plates 81, 82.

Figure 12:
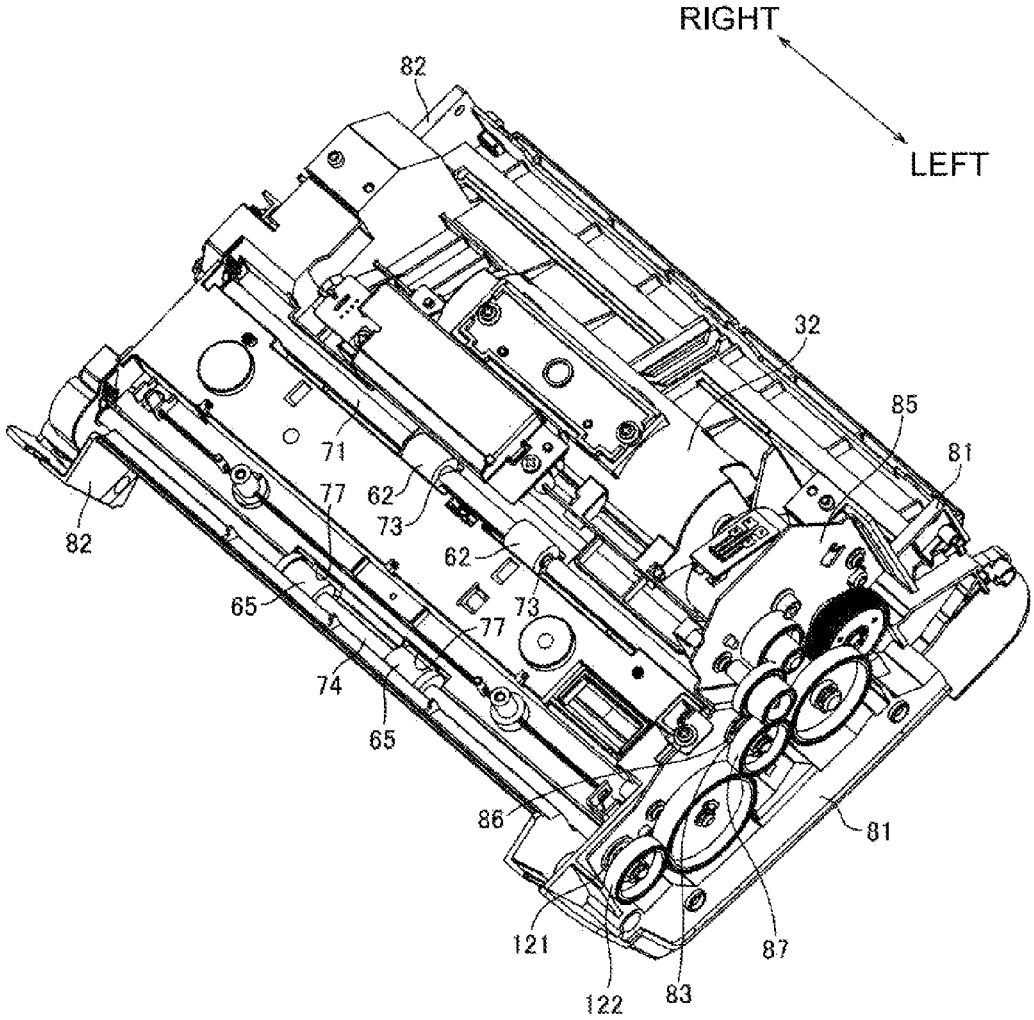
FIG. 12 is a bottom perspective view of the lower unit in which a LF roller gear and a left bearing of the image scanner are removed.

A left end of the output roller shaft 74 may be rotatably inserted into a left bearing 121 (depicted in FIG. 12) supported by the metal plate 85. The left end of the output roller shaft 74 may protrude leftward from the left bearing 121. As depicted in FIG. 12, an output roller gear 122 may be mounted on a portion of the output roller shaft 74 protruding from the left bearing 121 so as not to rotate relative to the output roller shaft 74, e.g., the output roller gear 122 may rotate together with the output roller shaft 74.

A right end of the output roller shaft 74 may be rotatably inserted into a bearing member, e.g., a right bearing 89, as depicted in FIG. 6. The right bearing 89 may be fitted in a bearing holding hole, e.g., a right bearing holding hole 90, formed in the right side plate 82.

The right bearing 89 and the right bearing holding hole 90 may be structured similar to the right bearing 84 and the right bearing holding hole 88, respectively. Like numerals are used for both components of the right bearings 84, 89 and for both components of the right bearing holding holes 88, 90 in FIGS. 6 and 8-13 and detailed description of the right bearing 89 and the right bearing holding hole 90 is omitted.

Figure 7:
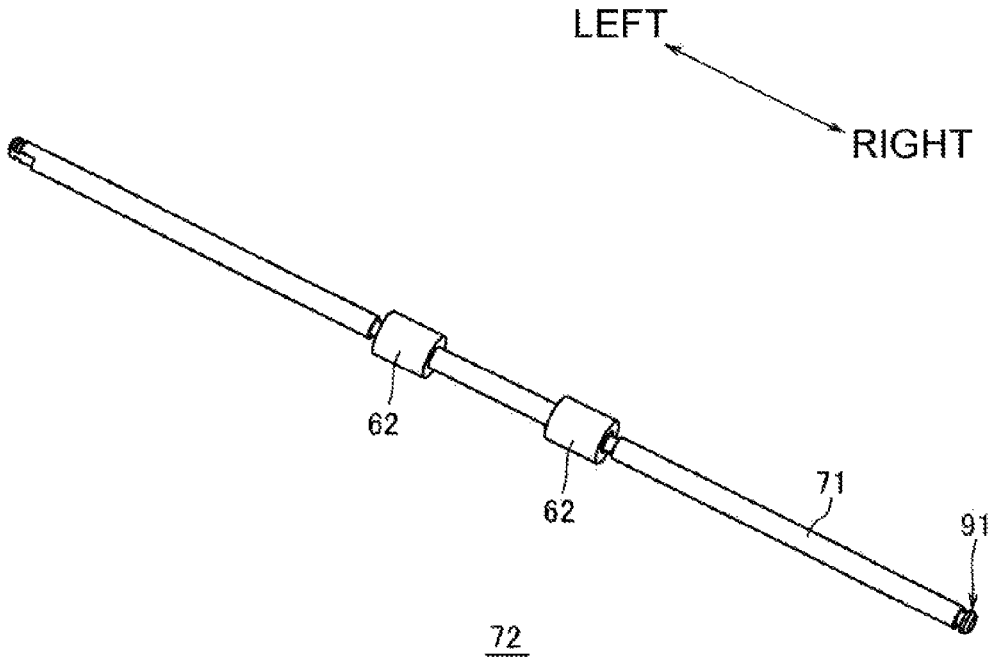
FIG. 7 is a perspective view of a LF roller member of the image scanner.

As depicted in FIG. 7, the LF roller shaft 71 may be a long narrow cylindrical rod.

A portion of the periphery of the left end of the LF roller shaft 71 may be cut out to have a D shape in cross section. The left bearing 83 may be inserted over the cylindrical portion of the LF roller shaft 71 on the right side of the portion of the LF roller shaft 71 having a D shaped cross section. The LF roller shaft 71 may be rotatably inserted into the left bearing 83. The portion of the LF roller shaft 71 having a D shape in cross section may be inserted into a D-shaped opening of the LF roller gear 87 in cross section. The LF roller gear 87 may be mounted on the left end of the LF roller shaft 71 so as not to rotate relative to the LF roller shaft 71, e.g., the LF roller gear 87 may rotate together with the LF roller shaft 71.

As depicted in FIG. 7, a groove 91 may be formed around the right end of the LF roller shaft 71.

The output roller shaft 74 may be similar to the LF roller shaft 71. Therefore, detailed description of the output roller shaft 74 is omitted.

Figure 8:
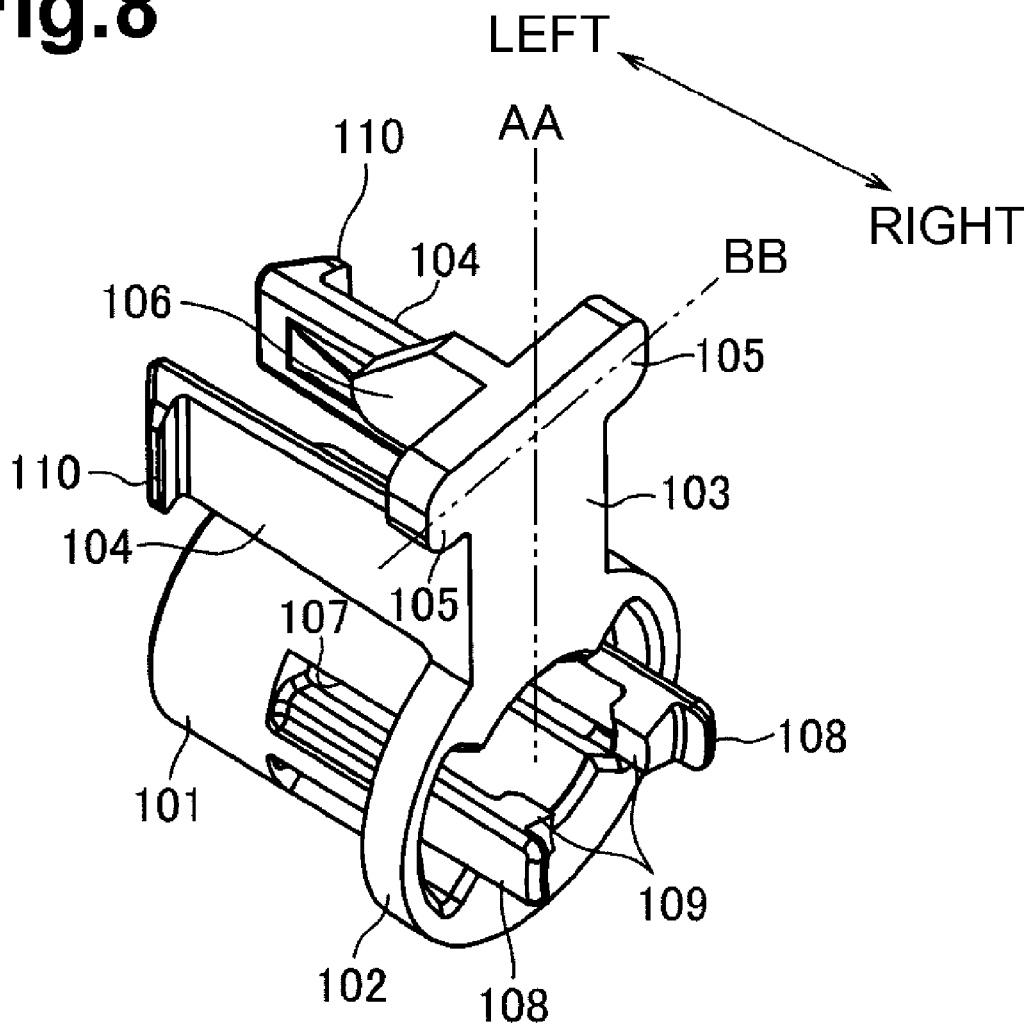
FIG. 8 is a right perspective view of a right bearing of the image scanner.
Figure 9:
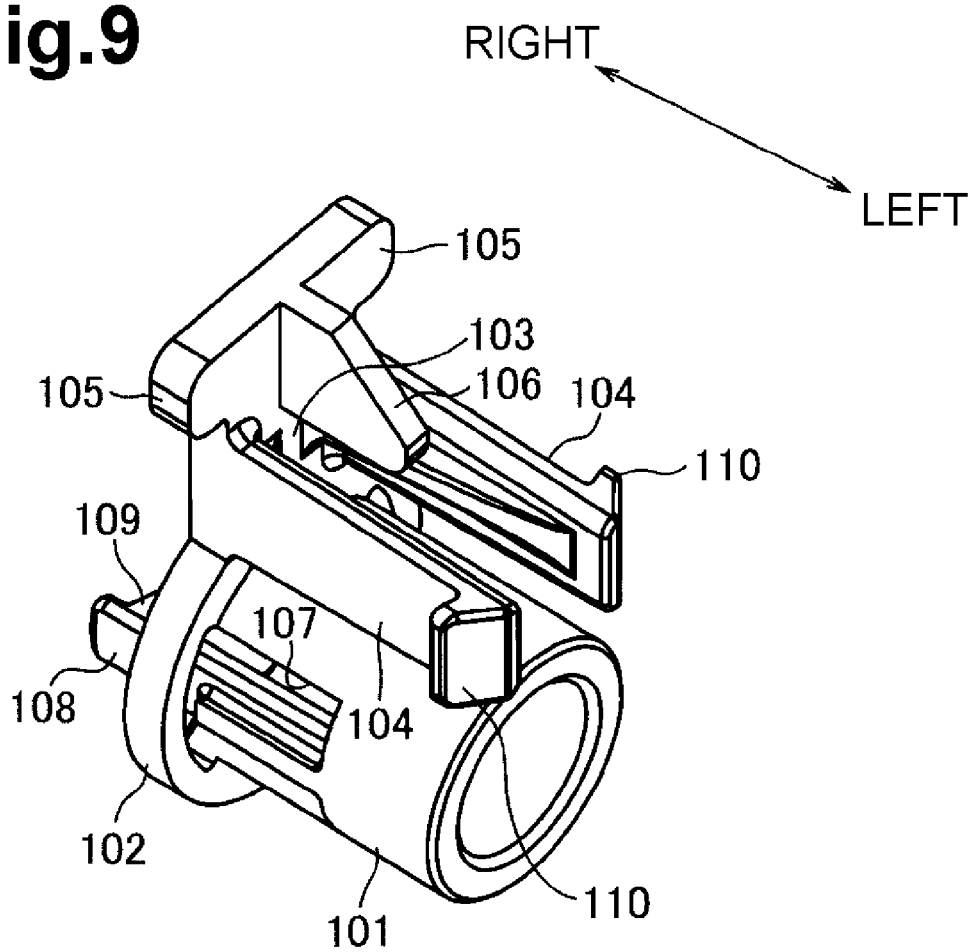
FIG. 9 is a left perspective view of the right bearing.

The right bearing 84 may be integrally formed of resin into one piece. As depicted in FIGS. 8 and 9, the right bearing 84 may comprise a bearing portion, e.g., a shaft inserting portion 101 and a flange 102. The right bearing 84 may comprise an engaged portion, e.g., a plate portion 103 and a pair of engagement portions 104. The right bearing 84 may comprise a pair of projections 105 and a protrusion 106.

The shaft inserting portion 101 may have a cylindrical shape.

The flange 102 may protrude from an end of the shaft inserting portion 101, e.g., a right end of the shaft inserting portion 101 toward the left side when the right bearing 84 is mounted on the side plate 82. The flange 102 may protrude around the shaft inserting portion 101.

The plate portion 103 may extend from a portion of the flange 102 in a radial direction of the shaft inserting portion 101.

The engagement portion 104 may extend from each side of the plate portion 103 toward the shaft inserting portion 101, e.g., toward the left side when the right bearing 84 is mounted on the side plate 82.

The projection 105 may extend from each side end of the plate portion 103 in a width direction BB perpendicular to an extending direction AA of the plate portion 103 and the engagement portion 104, as depicted by double dotted lines in FIGS. 6 and 8. When the right bearing 84 is fitted in the right bearing holding hole 88, the projections 105 may extend from the plate portion 103 in the width direction BB.

The protrusion 106 may protrude from a surface of the plate portion 103 on the side of the shaft inserting portion 101. The protrusion 106 may extend in the same direction as the extending direction AA of the plate portion 103. The protrusion 106 may generally have a trapezoidal plate shape when viewed from a direction depicted by double dotted lines in FIGS. 6 and 8. When the bearing 84 is fitted in the right bearing holding hole 88, the protrusion 106 may extend from the plate portion 103 toward the left side and in the extending direction AA.

The shaft inserting portion 101 may have a slit 107 that may be formed by cutting a portion of the shaft inserting portion 101 out in a rectangular shape from an end of the shaft inserting portion 101 on the side of the flange 102. The slit 107 may be disposed at two positions 180 degrees apart with respect to the central axis of the shaft inserting portion 101, e.g., the slits 107 may be symmetrically positioned with respect to the central axis of the shaft inserting portion 101. A latch 108 may extend toward and past the flange 102 from a central portion of a circumferential edge of the slit 107. Each of the latches 108 may comprise a shaft stopper protrusion 109 that may protrude inwardly in a facing direction of the latches 108 from a tip of each latch 108. The shaft stopper protrusion 109 may have a square block shape that may engage in the groove 91 of the LF roller shaft 71.

Each engagement portion 104 may comprise an engagement protrusion 110 disposed at an end of the engagement portion 104. The engagement protrusions 110 may protrude outward in a facing direction of the engagement portion 104. Each engagement protrusion 110 may have a substantially triangular cross section becoming narrower (e.g., in some cases gradually narrower) toward a downstream side in a protruding direction of the engagement protrusion 110. The engagement portion 104 may engage with the side plate 82 when the bearing 84 is fitted in the right bearing holding hole 88.

As depicted in FIGS. 5 and 6, the right bearing holding hole 88 may comprise a receiving portion 111 and an extended portion 112.

The receiving portion 111 may have such a circular shape that allows the shaft inserting portion 101 of the right bearing 84 to engage in the receiving portion 111. In some examples, the receiving portion 111 may have the same or approximately the same diameter as an outer diameter of the shaft inserting portion 101.

The extended portion 112 may extend in a rearward and downward direction from the receiving portion 111. The width direction BB may be the direction perpendicular to the extending direction AA of the extended portion 112. The extended portion 112 may have such a rectangular shape that allows the engagement portion 104 of the right bearing 84 to engage with the extended portion 112. The extended portion 112 may have a width in the width direction BB greater than an outer diameter of the LF roller shaft 71.

A frame portion, e.g., a spacer 113 may be disposed on a right surface of the right side plate 82. The spacer 113 may protrude from a peripheral edge of the right bearing holding hole 88. The height of the spacer 113, e.g., an amount that the spacer 113 protrudes from the right surface of the side plate 82, may be designed such that a distance between the left surface of the side plate 82 and a distal end of the spacer 113 may be approximately the same as a distance between a surface of the flange 102 of the right bearing 84 on the side of the shaft inserting portion 101 and the engagement protrusion 110 of the engagement portion 104. The spacer 113 may comprise a first frame portion 113A, a pair of second frame portions 113B and a third frame portion 113C. The first frame portion 113A may have a circular shape when viewed from the right side. The pair of second frame portions 113B may extend in the extending direction AA perpendicular to the axial direction of the LF roller shaft 71 and the output roller shaft 74 from the first frame portion 113A. The third frame portion 113C connects with the pair of second frame portions 113B. The right bearing holding hole 90 may be surrounded by the spacer 113. The right side of the LF roller shaft 71 and the output roller shaft 74 may be inserted into each right bearing holding hole 90. The flange 102 may contact the first frame portion 113A. The receiving portion 111 may be a part of the first frame portion 113A. The extended portion 112 may be a part of the pair of second frame portions 113B and the third frame portion 113C.

Figure 10:
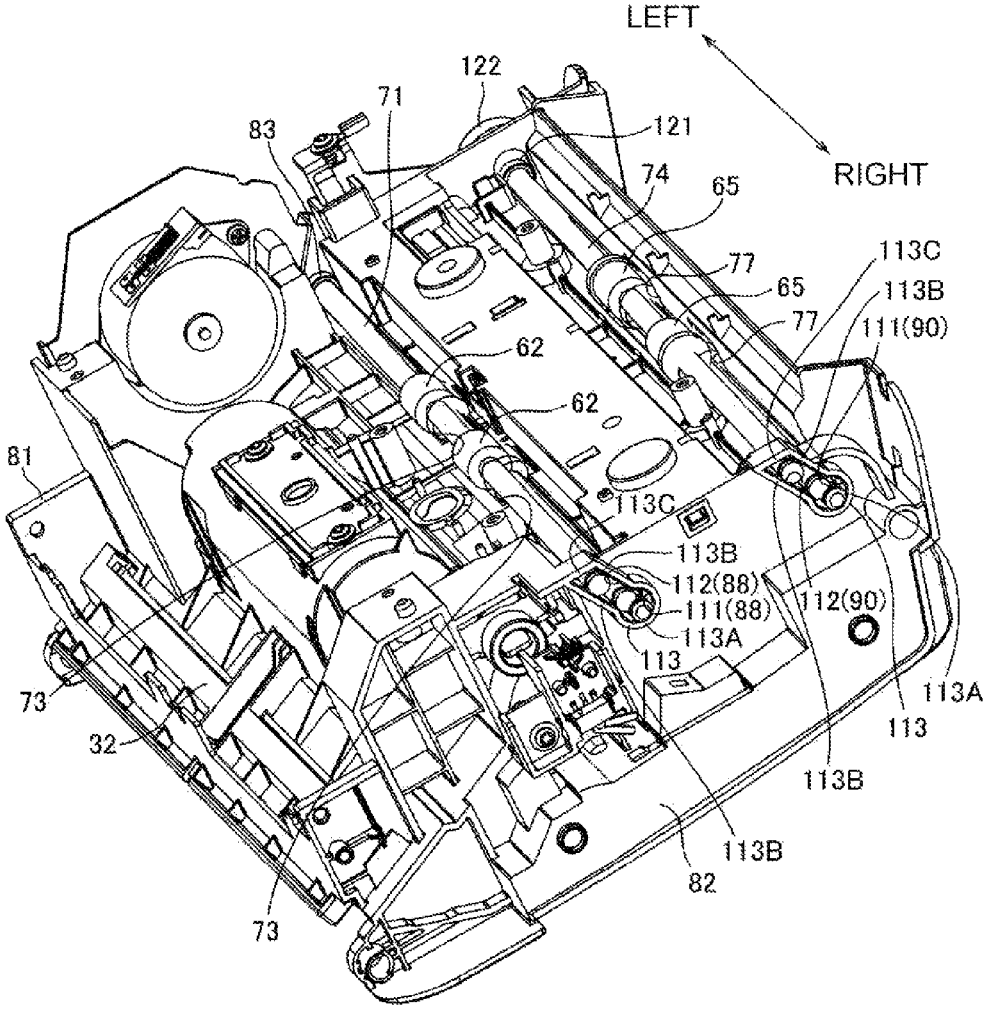
FIG. 10 is a bottom perspective view of the lower unit wherein the LF roller member and an output roller member of the image scanner are being mounted on or removed from the image scanner.

To mount the LF roller member 72 between the side plates 81, 82, the scanner 1, for example, may be turned upside down, as depicted in FIG. 10. The right end of the LF roller shaft 71 may be inserted into an end portion of the extended portion 112. Then, the left end of the LF roller shaft 71 may be inserted into the left bearing holding hole 86 formed in the metal plate 85 from the right side. At this time, the LF roller shaft 71 may be slanted such that its right end may be positioned upward. The LF rollers 62 may be positioned away from the relevant openings 73 formed in the lower frame 32.

Figure 11:
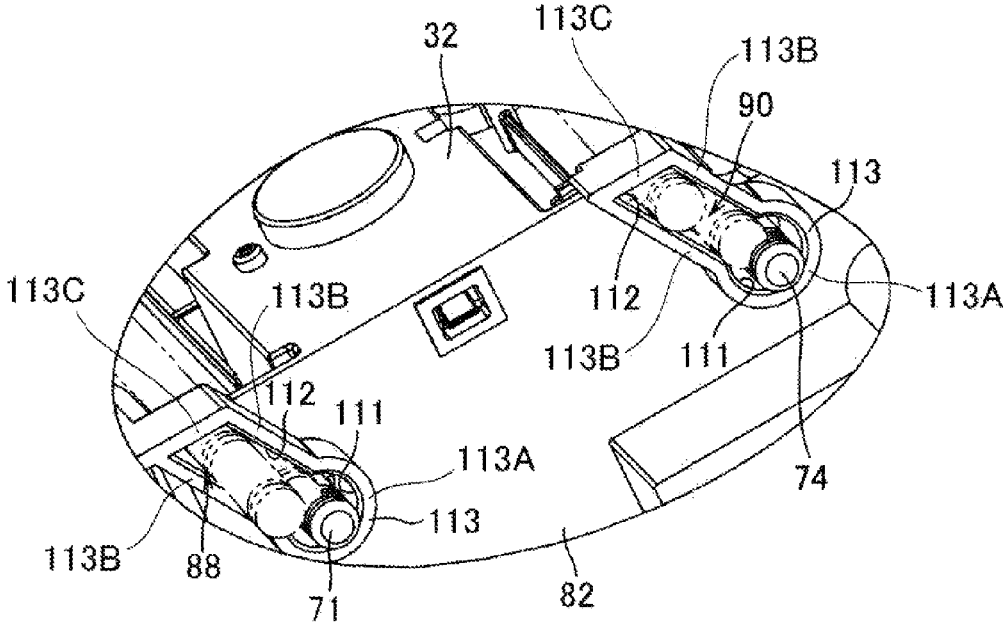
FIG. 11 is a perspective view of a right bearing holding hole of the image scanner and a periphery of the right bearing holding hole.

Thereafter, the right end of the LF roller shaft 71 may move from the extended portion 112 to the receiving portion 111, as depicted in FIG. 11. As the right end of the LF roller shaft 71 is positioned at a central portion of the receiving portion 111, each LF roller 62 may be disposed in the relevant opening 73 formed in the lower frame 32.

Thereafter, as depicted in FIG. 12, the left bearing 83 may be fitted in the left bearing holding hole 86 formed in the metal plate 85 from the left side. The left end of the LF roller shaft 71 may be inserted into the left bearing 83. Thereafter, the LF roller gear 87 may be mounted on a portion of the LF roller shaft 71 protruding from the left bearing 83.

As depicted in FIG. 6, the right bearing 84 may be fitted in the right bearing holding hole 88 from its right side. For example, while the right end of the LF roller shaft 71 is inserted into the shaft inserting portion 101 of the right bearing 84, the shaft inserting portion 101 of the right bearing 84 may be inserted into the receiving portion 111 of the right bearing holding hole 88 from its right side. Each engagement portion 104 of the right bearing 84 may be inserted into the extended portion 112 of the right bearing holding hole 88 from its right side. At this time, each engagement protrusion 110 of the engagement portion 104 may contact an inner surface of the spacer 113. The ends of the engagement portions 104 may elastically deform in a direction toward each other. The right bearing 84 may be pushed into the right bearing holding hole 88 until the flange 102 and the projections 105 contact the distal end of the spacer 113. As the flange 102 and the projections 105 contact the distal end of the spacer 113, each engagement portion 104 may return to its original position due to its elasticity. Consequently, the engagement protrusion 110 of each engagement portion 104 may engage with the left surface of the side plate 82. Thus, the shaft inserting portion 101 may fit in the receiving portion 111 and each engagement portion 104 may engage with the extended portion 112. As described above, the LF roller member 72 may be mounted between the side plates 81, 82.

Figure 13:
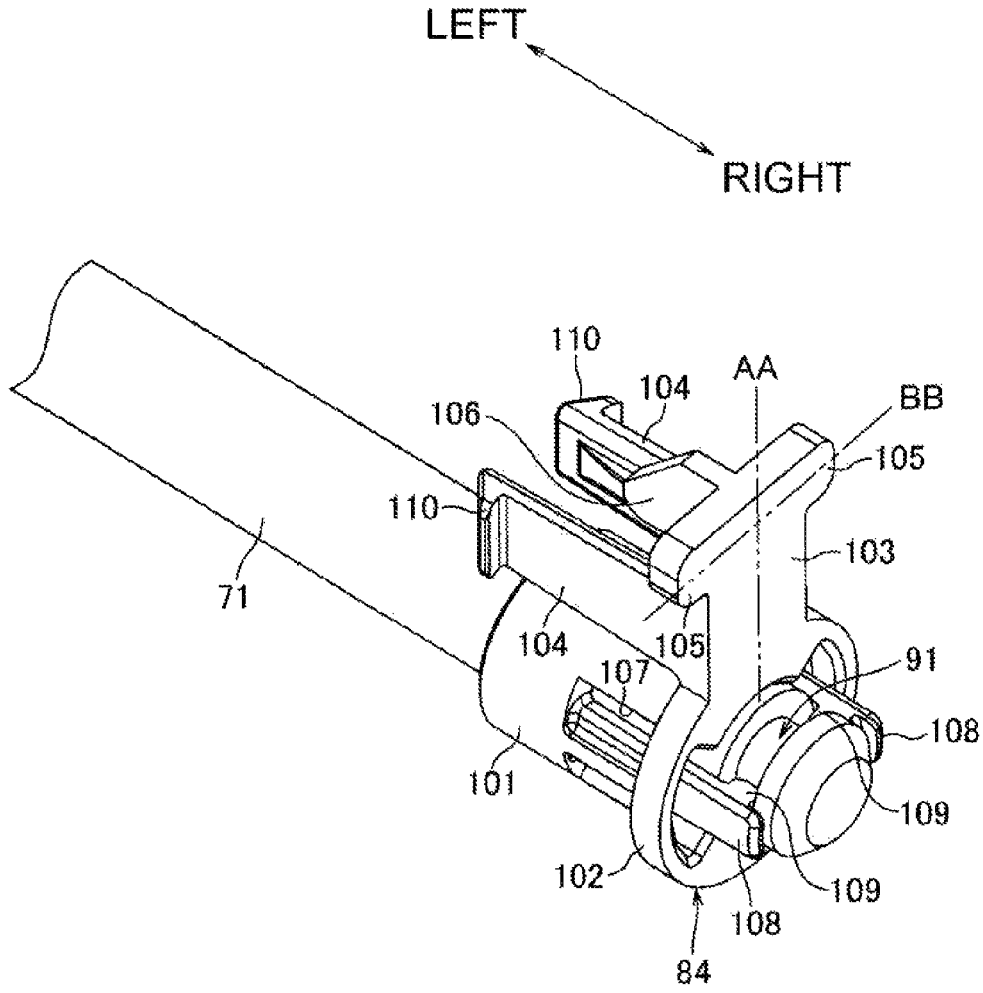
FIG. 13 is a perspective view of a portion of a LF roller shaft of the image scanner and the right bearing wherein a right end of the LF roller shaft is supported by the right bearing.

While the right bearing 84 is being fitted in the right bearing holding hole 88, the shaft stopper protrusion 109 of each latch 108 may contact the peripheral surface of an end portion of the LF roller shaft 71. Therefore, the latches 108 may elastically deform in a direction away from each other. As each shaft stopper protrusion 109 faces the groove 91 of the LF roller shaft 71, each shaft stopper protrusion 109 may fit in the groove 91, as depicted in FIG. 13. Each latch 108 may return to its original position due to its elasticity. Thus, the LF roller shaft 71 may be rotatably held by the right bearing 84 while being positioned in its axial direction.

The output roller member 75 may be mounted between the side plates 81, 82 in a manner similar to the manner in which the LF roller member 72 is mounted between the side plates 81, 82.

The LF roller member 72 may be removed from the side plates 81, 82 in a retrograde manner to mount the LF roller member 72 between the side plates 81, 82.

In one example, each engagement portion 104 may be elastically deformed to bring ends of the engagement portions 104 closer to each other. Each latch 108 may be elastically deformed such that tips of the latches 108 move away from each other. While the engagement portions 104 and the latches 108 are elastically deformed, the right bearing 84 may be moved rightward. As the latches 108 expand and separate from the LF roller shaft 71, the right bearing 84 may be removed from the right bearing holding hole 88.

The LF roller gear 87 may be removed from the left end of the LF roller shaft 71. Thereafter, the left bearing 83 may be removed from the left bearing holding hole 86.

Then, the right end of the LF roller shaft 71 may be moved from the receiving portion 111 to the extended portion 112. As the right end of the LF roller shaft 71 is positioned at the end portion of the extended portion 112, the LF roller shaft 71 may slant such that its right end may be positioned upward. The LF rollers 62 may be positioned away from respective openings 73 formed in the lower frame 32. The LF roller shaft 71 may be moved slightly rightward to remove the left end of the LF roller shaft 71 from the left bearing holding hole 86. Thereafter, the right end of the LF roller shaft 71 may be removed from the extended portion 112. Thus, the LF roller member 72 may be removed from the side plates 81, 82.

The output roller member 75 may be removed from the side plates 81, 82 in a manner similar to the manner in which the LF roller member 72 is removed from the side plates 81, 82.

As described above, the LF roller member 72 may comprise the LF roller shaft 71 and the LF rollers 62 mounted on the LF roller shaft 71. The lower frame 32 may have the openings 73 in which the LF rollers 62 may be accommodated. With the LF rollers 62 accommodated in the relevant openings 73, a portion of the peripheral surface of each LF roller 62 may protrude from the guide surface 76.

The side plate 82 may be disposed on the right side of the lower frame 32. The side plate 82 may have the right bearing holding hole 88 that may extend in the extending direction AA perpendicular to the axial direction of the LF roller shaft 71. The right bearing holding hole 88 may support the right bearing 84. An end of the LF roller shaft 71 may be rotatably supported by the right bearing 84.

The right bearing holding hole 88 may extend in the extending direction AA perpendicular to the axial direction of the LF roller shaft 71. Therefore, with the right bearing 84 removed from the right bearing holding hole 88, the LF roller shaft 71 may be moved in the right bearing holding hole 88. As the LF roller shaft 71 is moved in the right bearing holding hole 88, the LF rollers 62 of the LF roller member 72 may be accommodated in or removed from the relevant openings 73. Therefore, when the LF roller member 72 is mounted on or removed from the side plate 82, the side plate 82 may not have to be moved with respect to the lower frame 32. Thus, the LF roller member 72 may be mounted on or removed from the side plate 82 readily.

The right bearing 84 may comprise the shaft inserting portion 101 into which the LF roller shaft 71 may be inserted, and the engagement portions 104 engaged with the right bearing holding hole 88. The right bearing holding hole 88 may comprise the receiving portion 111 in which the shaft inserting portion 101 may engage and the extended portion 112 in which the engagement portions 104 may engage. The extended portion 112 may extend from the receiving portion 111 in the extending direction AA perpendicular to the axial direction of the LF roller shaft 71. The extended portion 112 may have a width (in the width direction BB perpendicular to the extending direction AA thereof) greater than the diameter of the LF roller shaft 71.

With the right bearing 84 removed from the right bearing holding hole 88, the LF roller shaft 71 of the LF roller member 72 may enter from the receiving portion 111 to the extended portion 112. Thus, the LF roller shaft 71 may more reliably move in the extending direction AA perpendicular to the axial direction of the LF roller shaft 71.

The right bearing 84 may further comprise the flange 102 that may protrude from the shaft inserting portion 101 around the shaft inserting portion 101.

As the flange 102 contacts a peripheral surface of the receiving portion 111 of the right bearing holding hole 88 in the side plate 82 from its right side, the right bearing 84 may not move leftward (e.g., may be prevented from moving leftward).

The right bearing 84 may further comprise the projections 105 that may extend from the plate portion 103 in the width direction BB perpendicular to the extending direction AA of the extended portion 112 when the right bearing 84 is fitted in the right bearing holding hole 88.

As the projections 105 contacts a peripheral surface of the extended portion 112 of the right bearing holding hole 88 in the side plate 82 from its right side, the right bearing 84 may not move leftward.

The right bearing 84 may comprise the protrusion 106 of a plate shape extending from the plate portion 103 in the leftward direction and in the extending direction AA of the extended portion 112 when the bearing 84 is fitted in the right bearing holding hole 88.

With the protrusion 106, the strength of the plate portion 103 may be increased.

The right bearing 84 may comprise the shaft inserting portion 101 and the engagement portion 104 that may be, in some examples, formed integrally into one piece.

With the structure, assembly of the right bearing 84 may be unnecessary and the number of components used for the right bearing 84 may be reduced.

The LF roller shaft 71 may have the groove 91 formed therearound. The right bearing 84 may comprise the latches 108 engaged with the groove 91.

With the latches 108 engaging with the groove 91, the LF roller shaft 71 of the LF roller member 72 may be positioned with respect to the right bearing 84 in the axial direction of the LF roller shaft 71.

The lower frame 32 and the side plates 81, 82 may be integrally formed into one piece.

With the structure, the number of components used for the image scanner 1 may be reduced and the strength of the lower frame 32 and the side plates 81, 82 may be increased.

While the disclosure has been described in detail with reference to the specific embodiment thereof, it would be apparent to those skilled in the art that various changes, arrangements and modifications may be applied therein without departing from the spirit and scope of the disclosure.

For example, the lower frame 32 and the side plates 81, 82 may be integrally formed into one piece, as described above. Nevertheless, the lower frame 32 and the side plates 81, 82 may be separately formed and the lower frame 32 may be combined with the side plates 81, 82.

In the above example embodiment, the image scanner 1 may comprise a sheet feeding device according to one or more aspects of the disclosure. However, in some embodiments, a sheet feeding device may be applied to other devices such as image forming devices, e.g., printers and copiers that may require a sheet feeding mechanism.

While the disclosure has included various example structures and illustrative embodiments, it will be understood by those skilled in the art that other variations and modifications of the structures and embodiments described above may be made without departing from the scope of the disclosure. Other structures and embodiments will be apparent to those skilled in the art in consideration of the specification or practice of the embodiments disclosed herein. It is intended that the specification and the described examples are illustrative.

What is claimed is:

1. An image reader comprising:

a shaft;

a roller mounted on the shaft, the roller being configured to rotate on the shaft and feed a sheet;

a guide having an opening at which the roller is disposed;

a first side plate disposed on one side of the guide in an axial direction of the shaft, wherein the first side plate comprises a frame portion and a first hole, wherein the frame portion comprises a first frame portion, a pair of second frame portions and a third frame portion, wherein the pair of second frame portions extends from the first frame portion in an extending direction perpendicular to the axial direction, wherein the third frame portion connects with the pair of second frame portions, wherein the first hole is entirely enclosed, in a radial direction of the first hole, by the first, second and third frame portions, and wherein the one side of the shaft is inserted into the first hole;

a first bearing member fitted in the first hole, wherein the first bearing member comprises:

a bearing portion configured to contact the first frame portion and configured such that one end of the shaft is rotatably held, the bearing portion comprising a flange and a cylindrical shaft inserting portion defining an insertion hole configured to receive insertion of the shaft, wherein the flange extends outwardly, in a radial direction of the cylindrical shaft inserting portion, and the flange is configured to contact the first frame portion from a side of the first side plate opposite to, in the axial direction, a side on which the guide is disposed; and an engaged portion extending in the extending direction from the flange, the engaged portion comprising an engagement portion configured to be engaged with the first side plate, wherein the engagement portion extends in the axial direction from the engaged portion such that the engagement portion is spaced apart from the bearing portion in the extending direction, a second side plate disposed on another side of the guide opposite to the one side of the guide in the axial direction of the shaft, wherein the second side plate has a second hole, wherein another end of the shaft, opposite the one end of the shaft in the axial direction, is inserted in the second hole;

a second bearing member disposed at the second side plate, wherein the second bearing member is configured such that the other end of the shaft is rotatably held; and a reading unit configured to read an image of the sheet.

2. The image reader according to claim 1, wherein a width between the pair of the second frame portions, in a width direction perpendicular to the extending direction and the axial direction, is greater than a diameter of the shaft.

3. The image reader according to claim 2, wherein the first bearing member comprises a projection that projects from the engaged portion in the width direction, and the projection contacts the pair of second frame portions of the first side plate on a side of the first side plate, in the axial direction, on which the guide is disposed.

4. The image reader according to claim 1, wherein the first bearing member comprises a protrusion, different from the engagement portion, that protrudes from the engaged portion in the axial direction and in the extending direction.

5. The image reader according to claim 1, wherein the one end of the shaft in the axial direction has a groove formed therearound, and the shaft inserting portion comprises a latch configured to engage in the groove.

6. The image reader according to claim 1, wherein the bearing portion and the engaged portion are integrally formed as one piece.

7. The image reader according to claim 1, wherein the guide and the first side plate and the second side plate are integrally formed as one piece.

8. The image reader according to claim 1, wherein a length of the engagement portion in the axial direction is greater than a thickness of the first side plate in the axial direction.

9. The sheet feeding device according to claim 1, wherein: the first hole of the first side plate has:

a receiving hole portion having a round shape and configured to receive engagement of the cylindrical shaft inserting portion; and an extended hole portion extending from the receiving hole portion in the extending direction and being configured to receive engagement of the engagement portion, the first frame portion has a round shape and surrounds the receiving hole portion, one of the pair of second frame portions is disposed in one side of the extended hole portion along the extending direction, the other of the pair of second frame portions is disposed in another side of the extended hole portion along the extending direction, and a distance between the pair of second frame portions is less than a diameter of the first frame portion.

* * * * *